United States Patent [19]

Jaton

[11] Patent Number: 4,474,521

[45] Date of Patent: Oct. 2, 1984

[54] METHOD AND DEVICE FOR CONTINUOUSLY FORMING A PACKET OF BOX BLANKS FOR FURTHER PROCESSING

[75] Inventor: Jean-Philippe Jaton, Chapelle, Switzerland

[73] Assignee: Bobst SA, Switzerland

[21] Appl. No.: 469,275

[22] Filed: Feb. 24, 1983

[30] Foreign Application Priority Data

Feb. 24, 1982 [CH] Switzerland ..... 1131/82

[51] Int. Cl.[3] ..... B65G 57/16

[52] U.S. Cl. ..... 414/31; 414/47; 414/50; 414/52; 414/55; 414/786; 198/374; 198/419

[58] Field of Search ..... 414/31, 47, 50, 52, 414/55, 786; 198/374, 419, 859

[56] References Cited

U.S. PATENT DOCUMENTS

| | | | |
|---|---|---|---|
| 3,488,693 | 1/1970 | Brinkmeier | 414/31 |
| 3,722,661 | 3/1973 | Williams | 198/859 X |
| 3,809,214 | 5/1974 | Reist | 198/374 |
| 3,851,773 | 12/1974 | Kluge et al. | 414/31 |
| 3,970,202 | 7/1976 | Speggiorin et al. | 414/31 |
| 4,015,724 | 4/1977 | Spencer | 414/31 |
| 4,264,255 | 4/1981 | Saro et al. | 414/31 |

FOREIGN PATENT DOCUMENTS 2827540 7/1980 Fed. Rep. of Germany .

*Primary Examiner*—Leslie J. Paperner

*Attorney, Agent, or Firm*—Hill, Van Santen, Steadman & Simpson

[57] ABSTRACT

A device for receiving a flow of box blanks from a delivery end of a box blank processing apparatus and assembling a packet of two batches of box blanks in a head-to-tail arrangement characterized by a receiving or batch-forming station for forming the batches of folded blanks from the flow, transporting arrangement for transporting the formed batches from the receiving station to a delivery station with at least every other batch being rotated through 180° so that at the receiving station the two batches can be superimposed with each other in a head-to-tail arrangement to form a packet which is then discharged to a second processing apparatus.

20 Claims, 15 Drawing Figures

FIG. 14
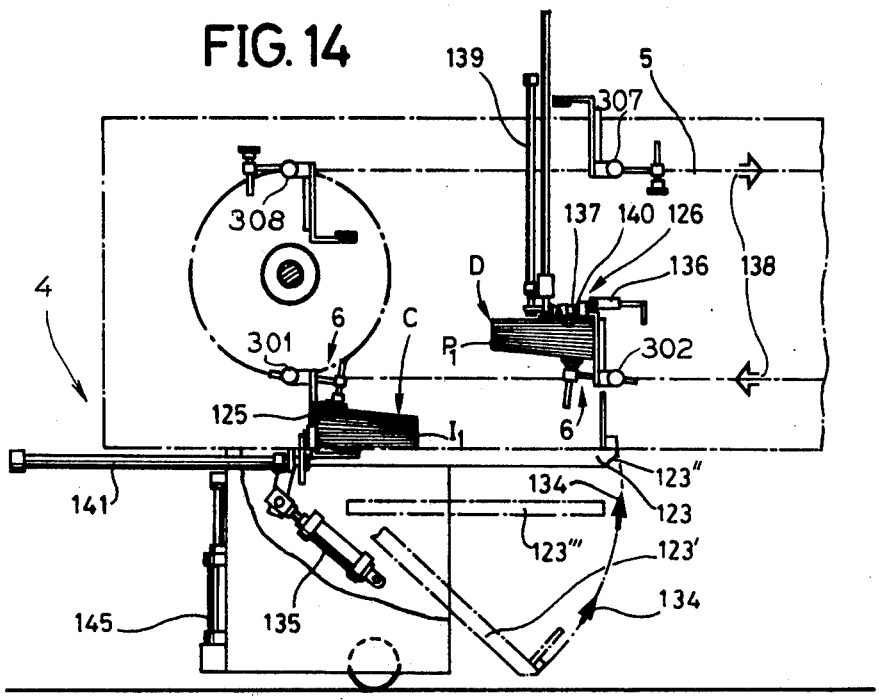
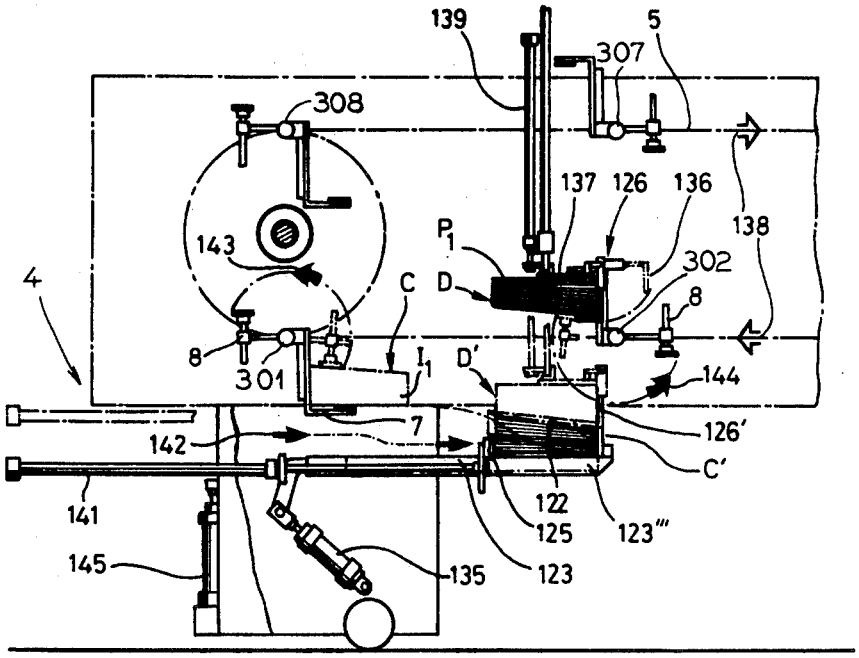
FIG. 15

METHOD AND DEVICE FOR CONTINUOUSLY FORMING A PACKET OF BOX BLANKS FOR FURTHER PROCESSING

BACKGROUND OF THE INVENTION

The present invention is directed to a method and a device to continuously form packets of box blanks such as folded boxes which are delivered from a delivery station of a folder-gluer device or apparatus which packets are further processed in an additional processing device or apparatus.

Several devices, which create batches of folded box blanks as they are received from a flow of box blanks from an apparatus such as a folder-gluer and make packets of the batches, are already well known. To facilitate the storing of the packet and the piling-up of the various packets, the batches are arranged in a head-to-tail arrangement. An example of a device forming the packets is disclosed in Swiss Pat. No. 572,433 of Dec. 31, 1975 which corresponds to U.S. Pat. No. 3,970,202. In this device, a packet is made up of two batches of folded box blanks which batches are arranged head-to-tail. A first batch is formed in a piling-up station by means of a lower conveyor. As soon as the desired number of boxes for the first batch is received in the piling-up station, a mechanism is actuated to deviate the arriving flow of boxes to a second or upper conveyor which transports the boxes onto a rotating grate of a second piling-up unit. As soon as this second batch of folded boxes is completed, the supply or flow of folded boxes is stopped and the rotating grate is shifted in order to lay the second batch down in a head-to-tail relationship on top of the first batch which is still located in the first piling-up unit. The packet formed in this way is then removed for instance by means of a conveyor arrangement that extends underneath the first piling-up unit.

Another device also piles up two batches of folded box blanks. In this device, the first batch is made up in a piling-up station by means of the conveyor with a rotative plate pivoting in a traveling direction of the boxes. The first batch is made up of the folded box blanks piling up on the rotating plate, and as soon as the desired number of boxes is reached, it is pivoted by 180°. Then the rotating plate bearing the first batch is lowered and a piling-up of a second batch on top of the first one can start. This device is disclosed in German Pat. No. 2,827,540 which corresponds to U.S. Pat. No. 4,264,255.

An advantage of both of the above mentioned devices is that it allows the elimination of manual turning of the batches of the folded box blanks. However, the first mentioned device has a disadvantage of requiring two separate units to form the first and second batches of folded box blanks, rotating means with a heavy mechanism which are required to overcome the effect of the weight of the batches when the batches of folded boxes are pivoted and finally the device requires two separate conveyors to form the batches of folded boxes.

The second mentioned device has the drawback that it turns the batches of folded boxes horizontally. In the tying of the resultant packet of the two batches, the folded boxes are not facing their opposite one in the packet. Another drawback of both devices is that the folded boxes are not always solidly gripped when the batches are stored and might be mixed up during the various operations. Moreover, both devices require a new start for each cycle and this continual starting and stopping excludes a continuous working mode of the device.

SUMMARY OF THE INVENTION

The present invention is directed to a device which overcomes the above mentioned drawbacks and enables continuous forming of compact packets of folded boxes which 13 compact packets enable further processing to be facilitated.

To obtain these goals and objects, the present invention is directed to a device for continuously receiving a flow of box blanks from a delivery end of a box blank processing apparatus and discharging a packet of two batches of box blanks in a head-to-tail arrangement to another processing apparatus. The device comprises receiving means for creating batches of box blanks from a flow of blanks; delivery means for assembling the two batches into a packet with a head-to-tail arrangement and discharging the packet to the next processing apparatus; and conveyor means for transporting the batches between the receiving means and the delivery means, said conveyor means including a chain means forming a continuous endless path between the receiving means and delivery means, a plurality of gripper means for grasping a batch of blanks being supported on the chain means with a given spacing, drive means for intermittently moving the chain means along the path with a dwell between movements, means for selectively actuating and deactuating the gripper means and means for rotating selected gripper means through 180° during movement along a portion of the path to form a turned batch, said receiving means including means for piling blanks in a stack, means for controlling the flow of blanks to the means for piling and for interrupting the flow while transporting a batch from the means for piling, and said delivery means including a first grasper means for gripping a batch in a gripper means of the conveyor means, second grasper means for gripping a following turned batch, said first and second grasper means being movable relative to each other to superimpose the two batches into a packet of two batches, and pusher means for moving the packet to a position for transfer to the next processing apparatus.

The device enables performing a method comprising the steps of forming a plurality of batches of the box blanks by receiving a flow of box blanks from said first processing apparatus, piling the blanks of the flow into a stack, intermittently interrupting the flow to enable a gripping of the stack of blanks and a removal of the stack as a batch from the area where the stack is formed and then resuming the step of piling to form a subsequent stack which when reaching the desired height is gripped and removed as a second batch; transporting the batches along a path, rotating every second batch by 180° around an axis extending transverse to the direction of movement in the path to create a turned batch; forming a packet by grasping the first batch at a delivery station, grasping the turned second batch at the delivery station, moving the first and second batches relative to each other to superimpose the batches together to form the packet of two batches with the batches in a head-to-tail arrangement; moving the packet of grasped batches with a pusher to a position for being received at a receiving end of the second apparatus and subsequently releasing the packet to enable discharge into the second apparatus.

Additional features of the invention will be readily apparent from the accompanying drawings and the specification.

BRIEF DESCRIPTION OF THE DRAWINGS

FIG. 14 is a schematic view illustrating the first step at the delivery station for forming a packet; and FIG. 15 is a diagrammatic view similar to FIG. 14 illustrating the subsequent steps of forming a packet.

DESCRIPTION OF THE PREFERRED EMBODIMENTS

Figure 1:
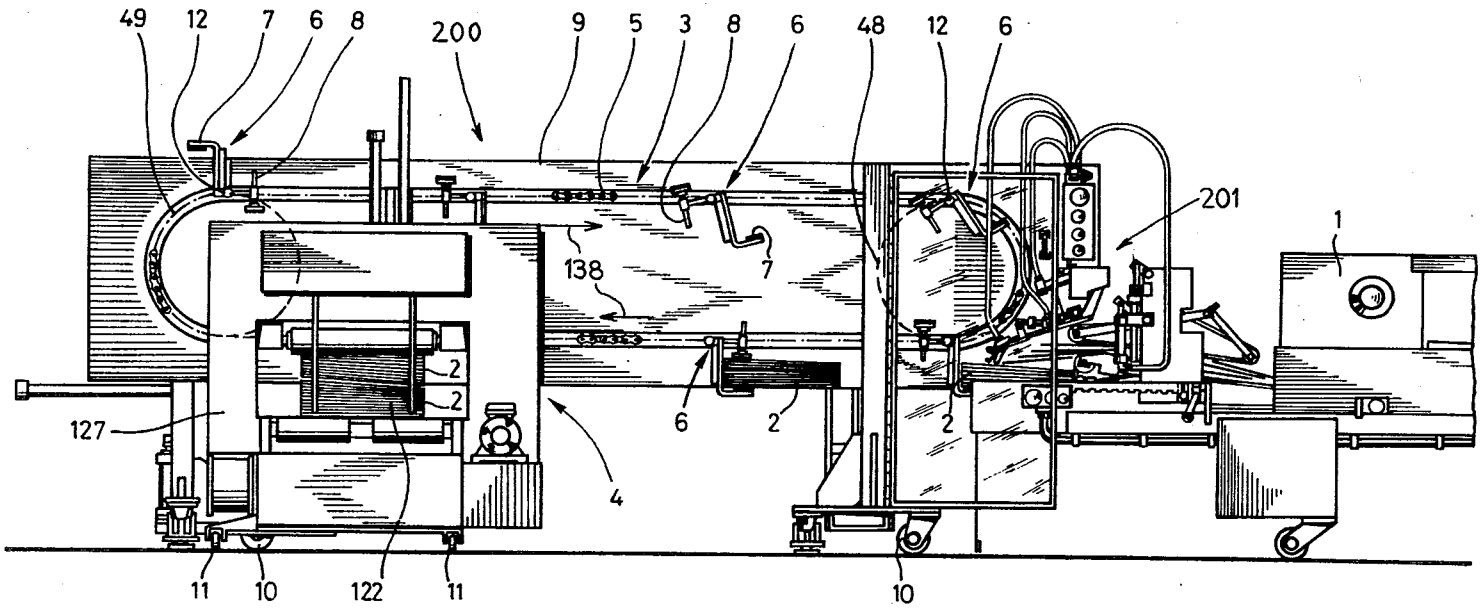
FIG. 1 is a side view of the device according to the present invention.

The principles of the present invention are particularly useful in a device generally indicated 200 in FIG. 1. The device 200 has a frame having a pair of lateral sides 9 which support a receiving means or batch forming station 201 at one end, a conveyor means 3 that extends from the batch forming station 201 to the opposite end which has a delivery station 4.

As illustrated, the device 200 is designed to be positioned with the receiving means 201 positioned to receive a flow of box blanks from a delivery unit 1 of a box blank processing device such as a folder-gluer and discharges a packet 122 from the delivery station in a direction extending substantially perpendicular to the direction of movement of the conveyor means 3, which direction is indicated by the arrows 138. The conveyor means 3 has a pair of endless chains 5 which are interconnected by equally spaced axles or shafts 12 and move in a path around a pair of chain sprockets 48 adjacent the receiving means 201 and a second pair of sprockets 49 adjacent the delivery means 4. Each of the axles or shafts 12 support a gripper means or pincher 6 which has a lower jaw 7 and an upper jaw 8. As illustrated, each of the gripper means or pinchers 6 are designed to pivot around an axis formed by the axle 12. In order to be able to move the device 200, it is mounted on rollers 10 so that it may be shifted from a position for receiving the material from the delivery unit 1 and a second processing unit such as a tying or bundling machine 127 which further processes the packets 122 is mounted on rollers 11 to enable movement. Each device such as the binding machine or apparatus 127 and the device 200 are provided with conventional retractable means, illustrated in the drawings, for rigidly holding the device in the desired position after it has been properly positioned.

Figure 2:
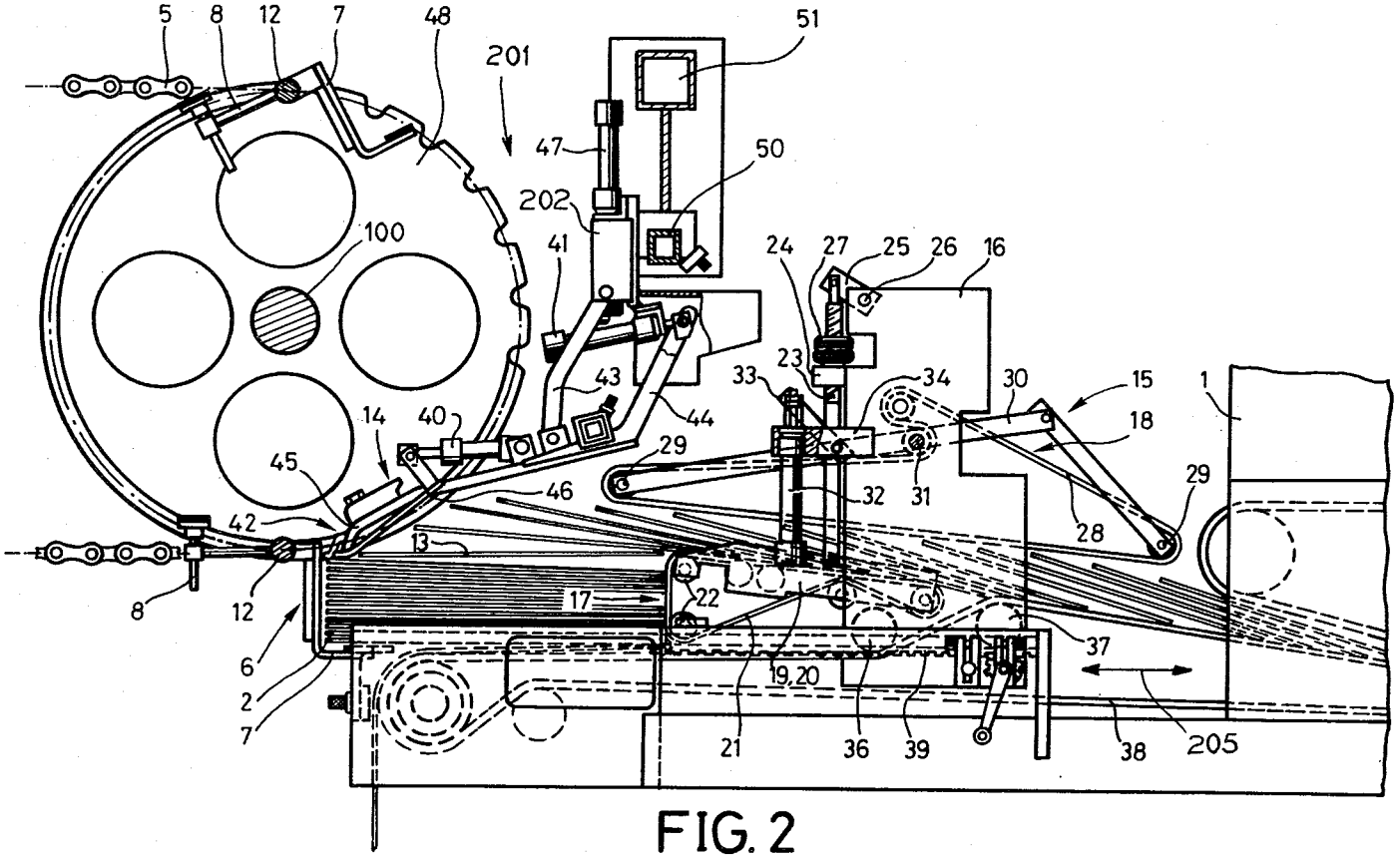
FIG. 2 is an enlarged side view with portions broken away for purposes of illustration of an input end of the device receiving a flow of blanks and forming a stack thereof.
Figure 3:
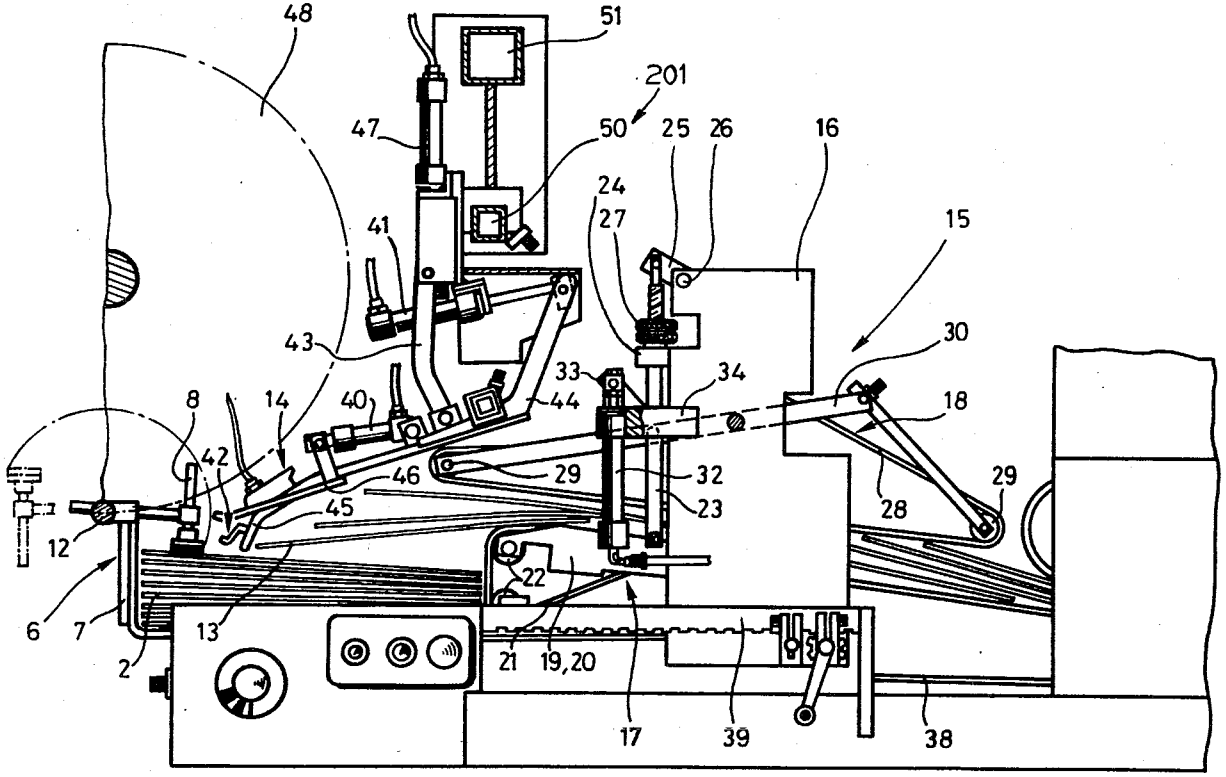
FIG. 3 is a side view of a portion of the input with the flow of blanks being temporarily interrupted in accordance with the present invention.

The receiving means 201 is best illustrated in FIGS. 2 and 3. As illustrated, it receives a flow of box blanks 13 which are being continuously delivered from a delivery unit 1 of a folder-gluer. As the flow of blanks 13 are received, they are piled up in a stack on a lower jaw 7 of a gripper means 6 which is positioned at the receiving means 201. To determine the number of blanks 13 in the stack, a detector means 14 will check the thickness of a batch or stack 2 of the folded box blanks and stop the piling of blanks as soon as the thickness of the batch reaches a value corresponding to the desired number of folded boxes 13 in the batch.

The batch forming station or receiving means 201 is equipped with an auxiliary transporting means generally indicated at 15 which is made up of two lateral plates 16 which are positioned on opposite sides of a lower conveyor 17 and an upper conveyor 18 which conveyors are both driven conveyors. The lower conveyor 17 comprises two lateral beams or frame members 19 and 20 between which a plurality of endless lower belts 21 are mounted on a series of rollers 22 for movement. The lower conveyor 17 is connected with each lateral plate 16 by means of a connecting rod 23 which is slidably received in a support 24 attached to each plate 16. The upper end of each connecting rod 23 is connected by a lever 25 to an axle 26 which extends between the two plates 16. Thus, motion of the connecting rod 23, which is created to raise and lower the position of the conveyor 17 due to the threading of adjustment nuts 27, will be transmitted to the opposite side of the conveyor 17 through the axle 26. The upper conveyor 18 is composed of a plurality of endless upper belts 28 which run over rollers 29 mounted between two lateral frame members 30. The frame members 30 are mounted for pivotal movement by an axle 31, which extends between the plates 16, and are pivoted on the axis of the axle 31 when a piston 32 mounted on a support bar 34 acts on a lever connected to one of the frame members 30. In addition to the upper and lower conveyors, the two plates 16 also support two rollers 36 and 37 which engage a belt 38 which is part of the delivery unit 1. The whole auxiliary transporting means 15 may be shifted horizontally along a direction of the arrow 205 by means of a rack 39. This adjustment along the direction 205 enables changing the size of the space for receiving the stack of blanks 13 when larger blanks are being processed.

The detecting means 14 in addition to detecting the number or the thickness of the stack forming the batch 2 also actuates a means for interrupting the flow of blanks as the batch is removed from the stacking or piling-on station. The means for interrupting include a withholding fork or fork unit 42, which is supported by a lever 43 from a member 202. The member 202 is received on a slide which is supported on a pair of cross members 50 and 51 and is movable in response to actuation of a piston 47 in a vertical direction. The fork 42 is made up of two fingers 45 and 46. The finger 46 is a guidance finger which is connected to a piston 40 which in turn is anchored on a finger 45. The finger 45 is pivotally attached to the lever 43 and has a lever 44 which is pivotally connected to a piston 41. On an opposite end from the lever 44, the finger 45 has a hook shape as best illustrated in FIG. 3. The fork 42 is movable from a first position where it does not interfere with the stacking of the blanks at the piling means to a second position illustrated in FIG. 3 where the hook of the finger 45 engages the leading ends of the blanks to interrupt the flow to the piling means. As illustrated, when in the first position, the guidance finger 46 is positioned relative to the hook of the finger 45 to preventing the catching of the hook on the leading edges of the blanks 13. However, when the fork 42 is moved to the second position (FIG. 3), the piston 40 has moved the finger 46 to a position to expose the hook of the finger 45 to cause the interrupting of the flow of blanks. Movement between the first and second positions is accomplished by the actuation of the piston 41. It should be noted that when the fork unit 42 is in the second position, it is withdrawn from the leading edge of the stack so that the upper jaw 8 of the gripper means 6 can be rotated from a withdrawn or disengaged position illustrated in FIG. 2 to a gripping or engaging position illustrated in FIG. 3.

Figure 11:
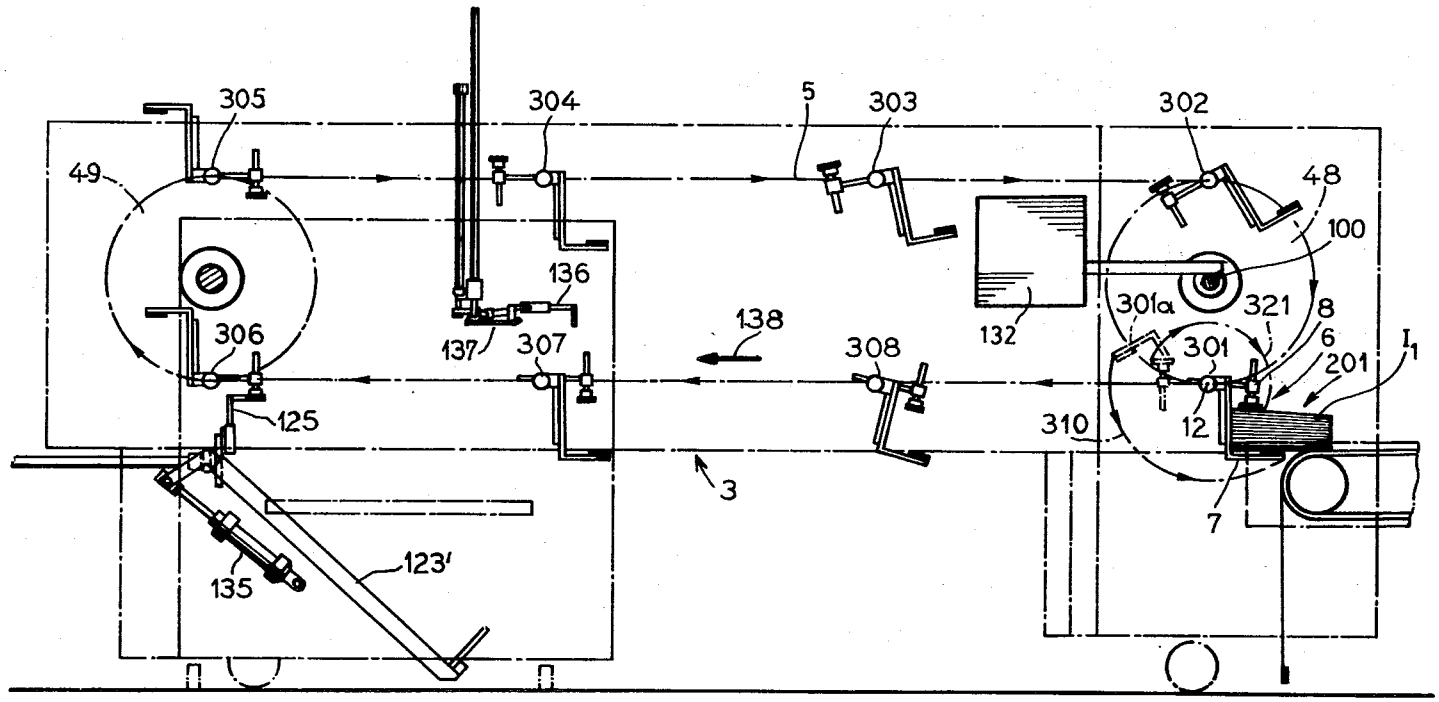
FIGS. 11, 12 and 13 are schematic views of the conveyor arrangement illustrating removing a pile from the piling arrangement at the input end, removing a second following pile and removing a third pile.

As best illustrated in FIG. 1, the conveyor means 3 comprises chains 5 which extend around a pair of chain sprockets 48 and 49 so that there is an upper run and a lower run. The gripper means or pinchers 6 are mounted on the axles 12 and are equally spaced along the length of the continuous chains 5. As illustrated in FIG. 11, eight gripper means 6 are provided and starting with the gripper means at the receiving station 201 and extending in a counter-clockwise direction which is opposite to the direction of movement 138 of the chains are numbered 301–308. The gripper means 301, 303, 305 and 307 are the odd gripper means while the gripper means 302, 304, 306 and 308 are considered the even gripper means. During movement by the conveyor means 3, the even gripper means will be rotated on the axle 12 by 180° as they move between the receiving station and the delivery station. The odd gripper means may either be held in a constant position without any rotation during this transfer or may be shifted approximately 60°.

Figure 5:
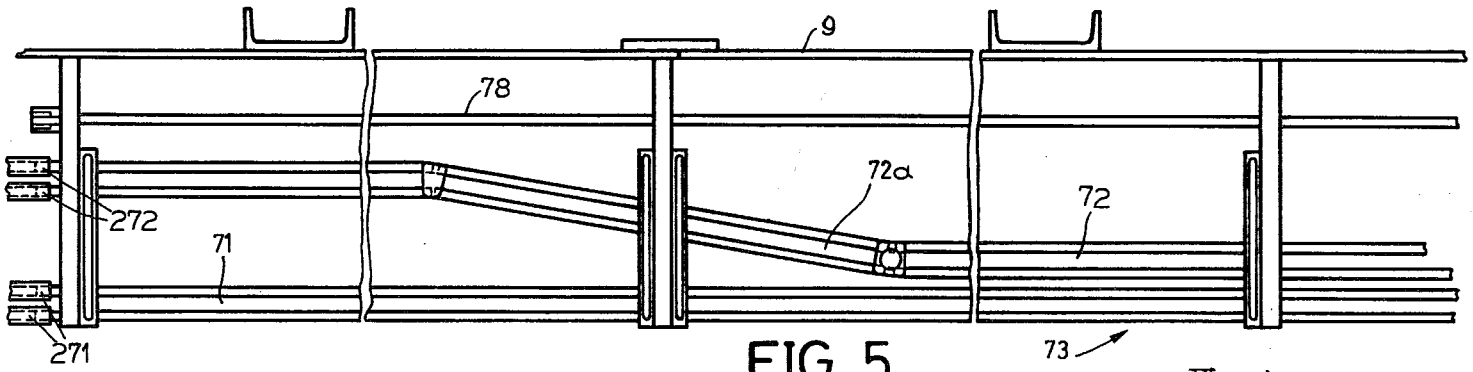
FIG. 5 is a plan view of an upper portion of the cam tracks of the conveying means.
Figure 4:
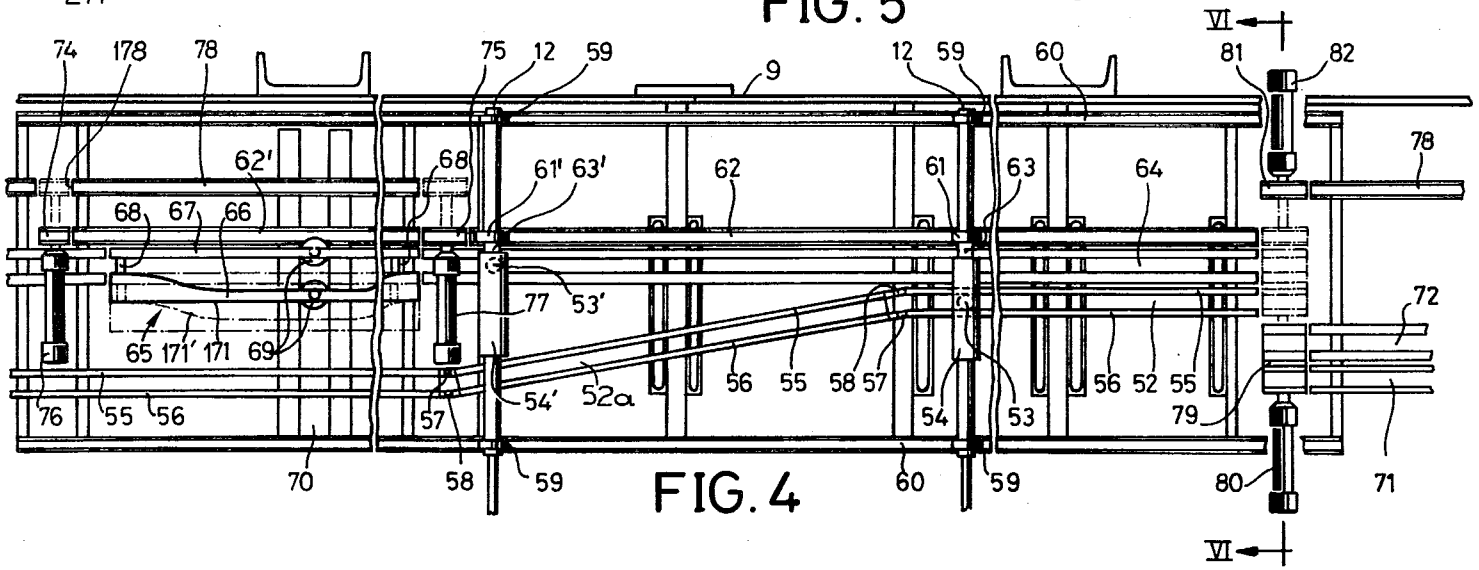
FIG. 4 is a plan view of a lower portion of the track of the conveying arrangement of the device in accordance with the invention.
Figure 6:
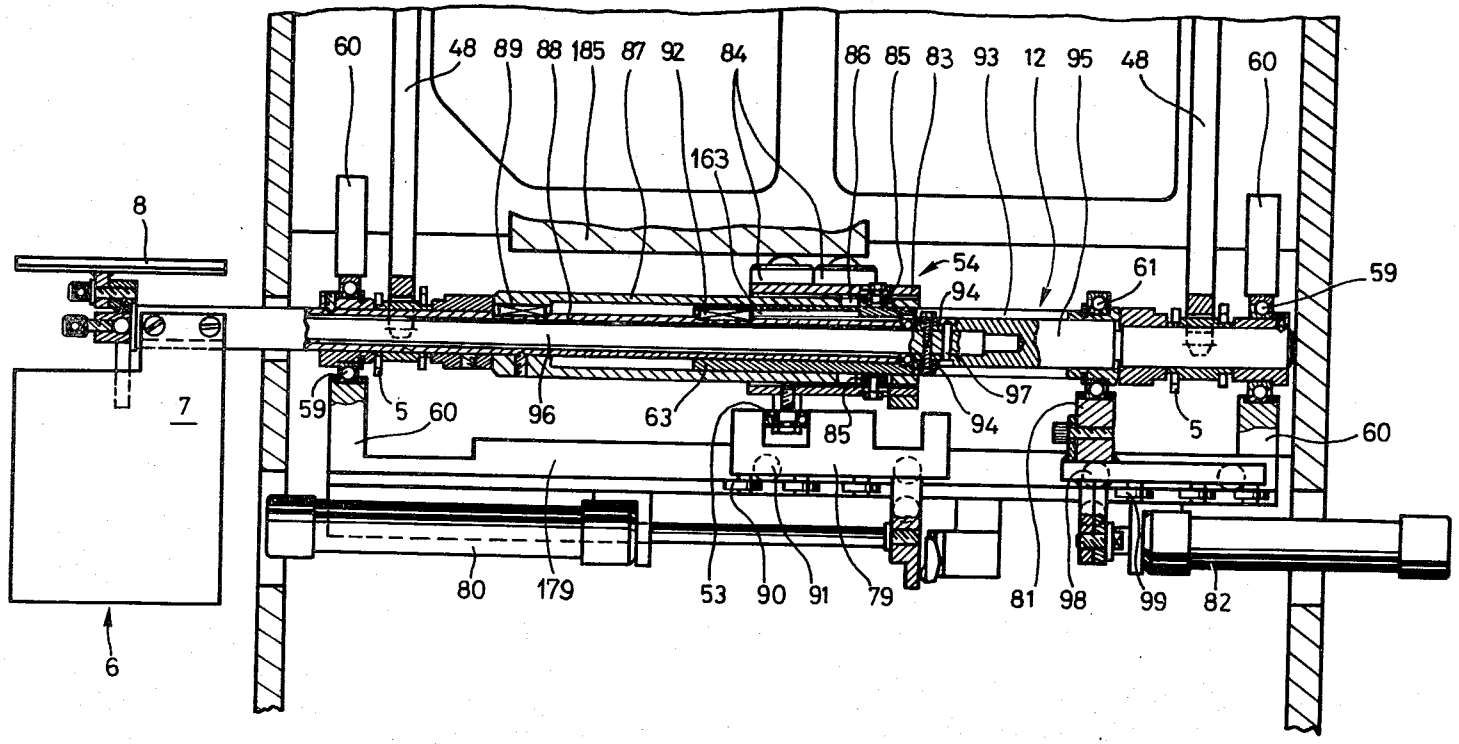
FIG. 6 is a cross-sectional view with portions in elevation taken along the lines VI—VI of FIG. 4.

In order to generate the various movements of the odd and even gripper means 301–308 as they move along the path created by the chains 5, a structure which is illustrated in FIGS. 4–6 is utilized. As illustrated in FIG. 4, this structure includes a first cam track or linear cam 52 which will help control the movement of the even-numbered gripper means 302, 304, 306 and 308 as the chain moves them between the receiving means or station toward the delivery station. This is accomplished by a follower or roller 53, which is mounted on a yoke 54 of the mounting arrangement, being received in the cam track 52 and causing a shifting of the yoke 54 along the axis of its respective axle 12. As illustrated, the cam track is formed by a pair of parallel spaced elements 55 and 56 which have portions interconnected by joints 57 and 58. Each of the shafts 12 is provided with rollers 59 which are spaced apart and are engaged in tracks 60 which are spaced along the frame of the device 200. Each of the yokes 54 has a slidable sleeve 63 which is connected to a roller or follower 61 which is received on a track 62. Lateral movement of the sleeve 63 due to changing the position of the roller 61 will actuate movement of the upper jaw 8 of each gripper means 6 relative to the lower jaw 7. Movement of the yoke 54 due to the roller 53 moving in a portion 52*a* of the track 52 will cause rotation or pivoting of the entire gripper means regardless of the position of the upper jaw relative to the lower jaw. The exact structure for accomplishing all of this will be discussed hereinafter.

In addition to the track means 52, a second cam track or slide guide 64 is provided. The slide guide or second track means 64 receive a roller 53′ on a yoke 54′ which is associated with each of the mounting means for the odd gripper means such as 301. As with the arrangement for the even gripper means such as 302, the yoke 54′ also has a sleeve 63′ with a roller 61′ which is on the roller track 62. The track 64 has a portion 65 formed by members 66 and 67 held together by cross-pieces 68. The member 66 has a curved cam surface while the member 67 has a straight surface. The portion 65 has a pair of guide rollers 69 which are received in a transverse extending guide 70 to control movement in a lateral direction from a first position 171 shown in bold lines to a second position 171′ shown in chain lines. This shifting can be accomplished by a pneumatic piston which is not illustrated and allows a partial rotation such as for 60° of each of the odd gripper means such as 301 when the movement of the odd and even gripper means have to be coordinated, for instance, while processing a long folded box blank.

The arrangement of the cam tracks 52 and 64 along with the roller track 62 illustrated in FIG. 4 engages the various rollers and sleeves of each of the gripper means which is moving along the lower run of the path. When in the upper run, the first cam track 52 has a portion 71 (FIG. 5) while the second cam track 64 has a portion 72. The portion 71 is connected to the lower portion of the track 52 on the left side by a circular rail arrangement 271 while the track 64 is connected to the upper portion 72 by a circular rail portion 272. The circular rail arrangement 271, not shown in great detail, guides the rollers 53 as the portion of the chain supporting the axle 12 and the yoke 54 is moved around the circumference of the sprocket wheels 49. In a similar manner, the circular rail arrangement 272 guides and receives the roller 53′ as it moves around the sprocket wheels. It should be noted that the cam track portion 72 is very similar to the lower portion of the cam track 52 in its structure and has a section 72*a* which causes a shifting of the follower 53′ and the yoke 54′ which lateral shifting on the axle creates a rotation of 180° of the gripper means mounted thereby. Thus, the portion 72 rotates each of the odd gripper means through 180° such as the movement of the gripper means 305 as it is sequentially illustrated in FIGS. 11–13.

The path of the linear cam portion 72 as well as the guide path of the portion 71 are positioned at the end 73 in order to retract both the even and odd gripper means 6 when they are moved around the sprocket wheels 48 so that it will not extend outwardly and interfere with the receiving means 201. Again, while moving around the sprocket wheel 48, each of the followers such as 53 and 53′ are guided by circular rails not illustrated in detail. Thus, each of the gripper means 6 when brought to the position of the gripper means 301 in FIG. 11 will be in a retracted position illustrated by the chain lines 301*a*. To shift the gripper means into a position for piling a stack of blanks on the lower jaw 7, a transfer device for laterally shifting each of the followers to a position that it had in its respective tracks 72 and 71 to the position in tracks 64 and 52 respectively is provided. This is accomplished by a slide arrangement 79 which is shifted from a position illustrated in FIG. 4 in bold lines to a position illustrated in broken lines by a pneumatic piston 80. The shifting will cause a rotation in a counter-clockwise direction of arrows 310 of each of the gripper means 6 on its respective axle 12 through an amount of approximately 180°.

As mentioned hereinabove, a track 62 receives rollers such as 61 and 61' which are attached to sleeves 63 and 63' and cause actuation of the upper jaw. The device also has a track 78 which is laterally displaced from the track 62 and coacts with the track 62 to extend along the entire path. The track 62 has a slide arrangement 75 which is moved from a position shown in bold lines connecting the track 62 to an extension 62' and is movable by a piston 77 to a position illustrated in bold lines to offset the roller laterally to enter the track 78. The track 78 has a gap 178 which is laterally aligned with the other end of track portion 62' and receives a slide 74 as illustrated in broken lines. The slide 74 is moved from a position aligned with the end of portion 62' to the position in the gap 178 in the track 78. This movement is controlled by a pneumatic piston 76. The track 78 is connected by curve guides to an upper portion illustrated in FIG. 5 which maintains the roller in the same lateral spacing. At a position aligned with the slide 79, the track 78 terminates in a slide 81 connected to a piston 82 which will transfer the roller laterally from the track 78 to be aligned to enter the track 62. As the roller is moved from the track 62 or 62' to the track 78, the shifting of the sleeve 63 will cause the upper jaw 8 to be shifted in a counter-clockwise direction as indicated by the arrow 320 in FIG. 12 to disengage a batch received on the lower jaw 7. Movement from the track 78 due to actuation of the slide 81 by piston 82 will cause the upper jaw to move in a clockwise direction indicated by the arrow 321 in FIG. 11 from a disengaged position to a position engaging a stack of blanks on the lower jaw 7.

While discussion of FIGS. 4 and 5 show the various tracks utilized for shifting the sleeves 63 and 63' as well as the yoke 54 and 54', a detailed view of this arrangement is illustrated in FIG. 6. As illustrated, a yoke 54 has a cylindrical member 83 provided with ball guide blocks 84 which are engaged on a guiding rail or surface 185 to eliminate rotation of the cylinder 83 during any lateral shifting of the yoke 54 which is caused by the roller 53 following the cam track 52 in the upper portion 71 or due to shifting of the slide 79. The cylindrical member 83 is equipped with two ball rollers 85, each of which is received in a separate helical-shaped groove 86 formed in a tube or sleeve 87. Thus, when the yoke 54 with the member 83 is shifted laterally, the rollers 85 moving in each of the respective grooves 86 will cause a rotation of the tube 87. The rotation of the sleeve 87 is transmitted to a sleeve 88 through a key 89. The sleeve 88 at one end supports the lower jaw 7 of each of the respective gripper means 6. As illustrated in FIG. 6, the yoke 54 has its roller 53 engaged in the slider 79 which has just been shifted to the right to pivot the gripper means 6 from a retracted position to a position with the lower jaw 7 aligned to receive a batch of blanks. The slider 79 is guided when it is shifted by rollers 90 and 91 riding on a track 179 of the frame of the device. The sleeve 88 also has a key 92 received in a groove 163 of the sleeve 63 to form a spline connection therebetween. Thus, the sleeve 63 can slide from a position illustrated in FIG. 6 to the left as the roller 61 is shifted from its rightmost position illustrated in the drawings by the slider 81 as it is shifted to the left by the piston 82. As illustrated, the slider 81 is guided by rollers 89 and 90 which are received on the track 179.

The sleeve 63 also has a pair of helical-shaped grooves 93. Each groove 93 receives a roller 94 which is mounted on an axle 96 which has a connecting piece 95. The connecting piece 95 is secured to the axle 96 a pin 97. The axle 96 extends through the sleeve member 88 and is connected to the upper jaw 8 of the pincher or gripper means 6. Because of the connection between the sleeve 88 and the sleeve 63 by means of the spline formed by the key 92 received in a groove 163, lateral shifting of the yoke 54 will rotate both the tube or sleeve 88 and the axle 96 to simultaneously pivot or rotate both the upper and lower jaws of the gripper means 6 together. However, lateral displacement of the roller 61 to cause displacement of the sleeve 63 will only generate a rotating of the axle 96 to rotate or pivot the upper jaw 8 between a disengaged position and an engaged position. It should be noted that the sleeves 87 and 88 and the axles 96 and 95 are parts of the transverse axle 12 which also supports the rollers 59 that are received in the tracks 60 for guidance as the chains 5 move the axle along the continuous path. It also should be noted that the yoke 54' and the sleeve 53' are constructed in exactly the same manner as the above description of the sleeve 63 and yoke 54 except with regard to the particular placement of the follower 53'.

Figure 7:
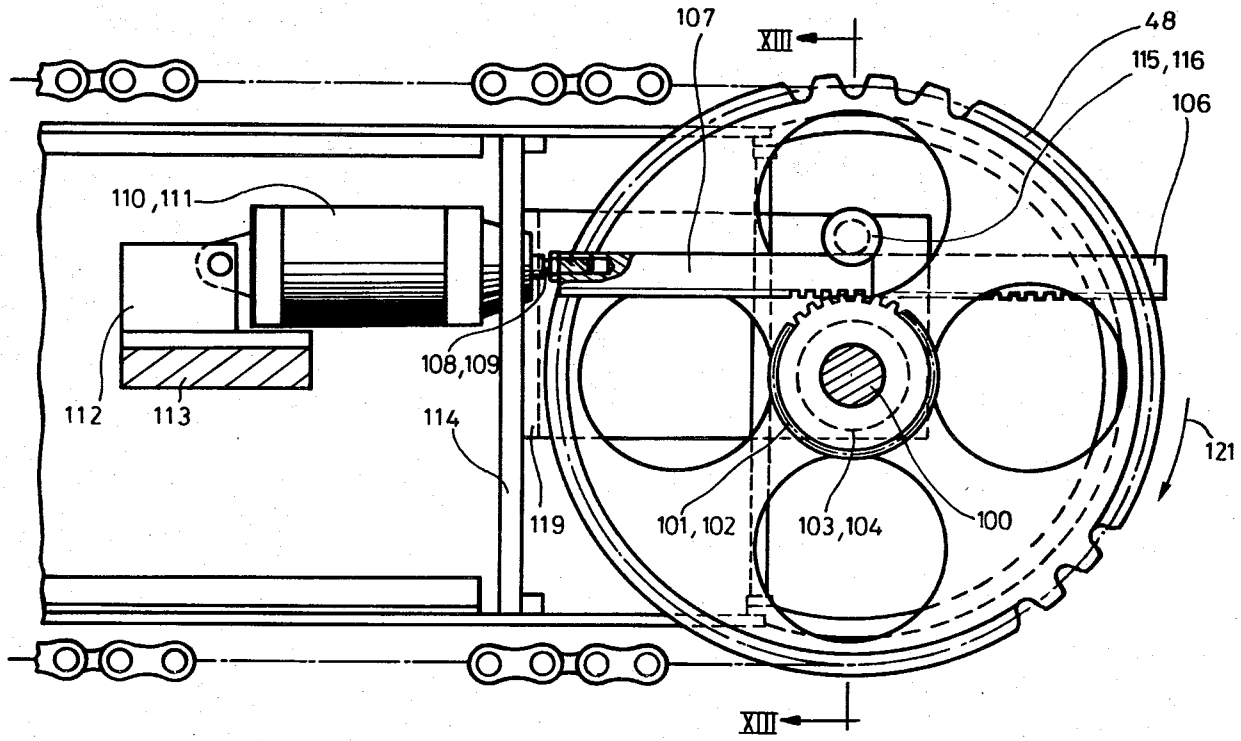
FIG. 7 is a longitudinal cross-sectional view at the input end illustrating the drive means for the conveyor device of the present invention.
Figure 8:
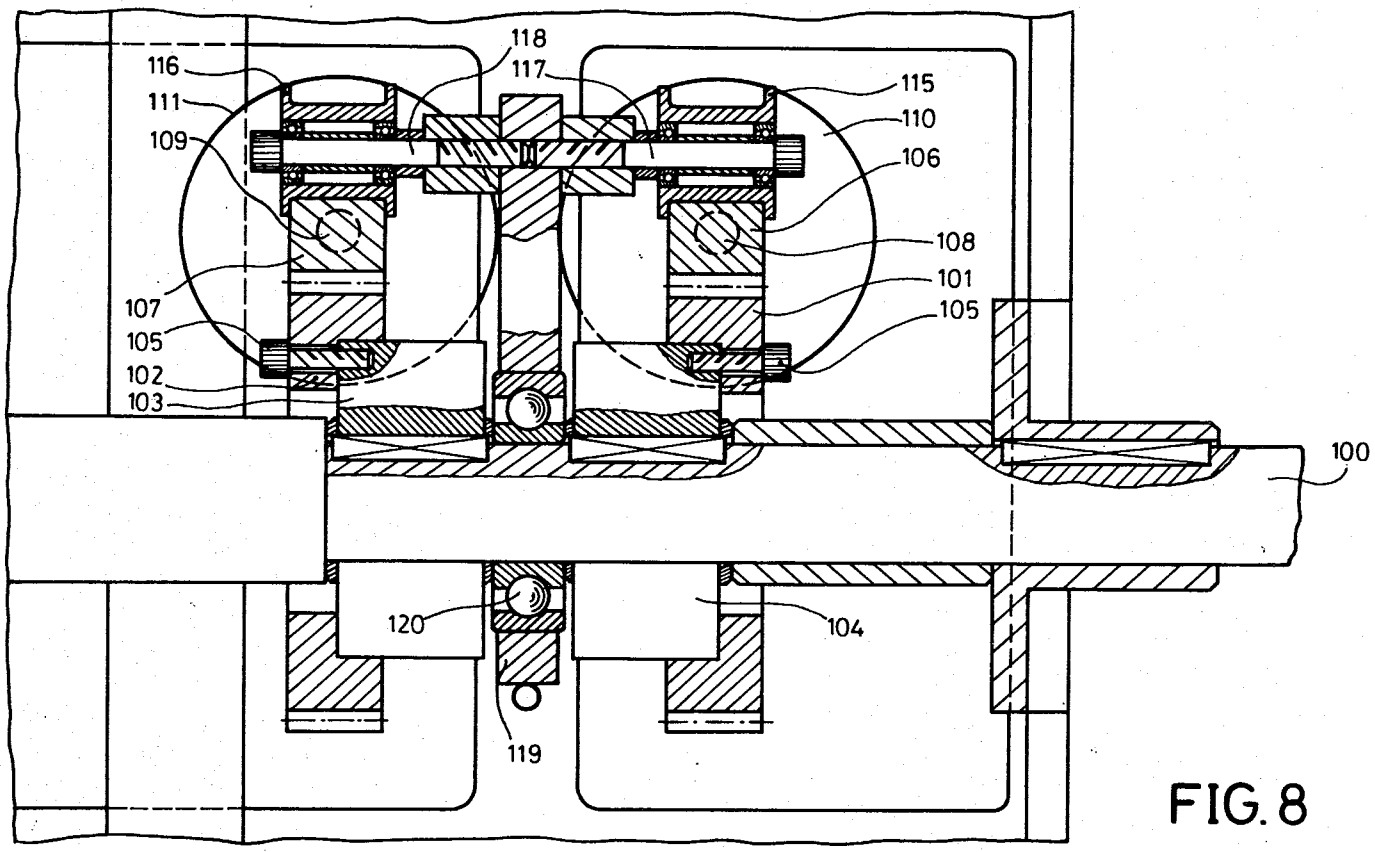
FIG. 8 is a cross-sectional view taken along the lines VIII—VIII of FIG. 7.

As mentioned hereinabove, the conveyor means 3 is intermittently advanced so that there is a dwell between movements by a drive means 132 (FIG. 11). Thus, when referring to FIG. 11, when a gripper means such as the odd gripper means 301 is positioned at the receiving station, it remains there during a dwell period as the pile or stack of blanks is formed thereon. Then, after the batch has been gripped, the conveyor means 3 will move a given amount so that the next following even gripper means 302 in a position to receive a stack of blanks and grasp a second or following batch. To accomplish this movement, the sprocket wheels 48 are connected to an axle 100 (FIG. 7). The drive means 132 include a pair of pinions 101 and 102 which are secured on one-way couplings or clutches 103 and 104, respectively, by fasteners such as screws 105. The one-way couplings or clutches 103 and 104 are keyed to the shaft 100. The pinion 101 is engaged by a rack gear 106 which is secured on the end of a piston rod 108 of a piston 110. In a similar manner, the pinion 102 is engaged by a rack 107 which is provided on an end of a piston rod 109 of a piston 111. The pistons 110 and 111 are pneumatic pistons and have one end mounted to a support 112 that is fitted on a cross-bar 113 and the opposite ends are secured to a front piece 114 of the frame. Each of the racks 106 and 107 are guided at its point of engagement with the pinions 101 and 102 by pressure rollers 115 and 116 which are secured by screws 117 and 118 on a center support 119 which also has a bearing support such as a roller bearing 120 for the axle 100. In view of the one-way clutch, when a piston is actuated to move a rack such as 107 from the retracted position illustrated in FIG. 7 to the advance position illustrated by the rack 106, a rotary motion of the shaft 101 in the sprocket gears 48 in the direction of arrow 121 will occur. However, a shifting from the advance position of rack 106 back to the retracted position of rack 107 due to the one-way clutch will not cause any rotational motion.

Figure 9:
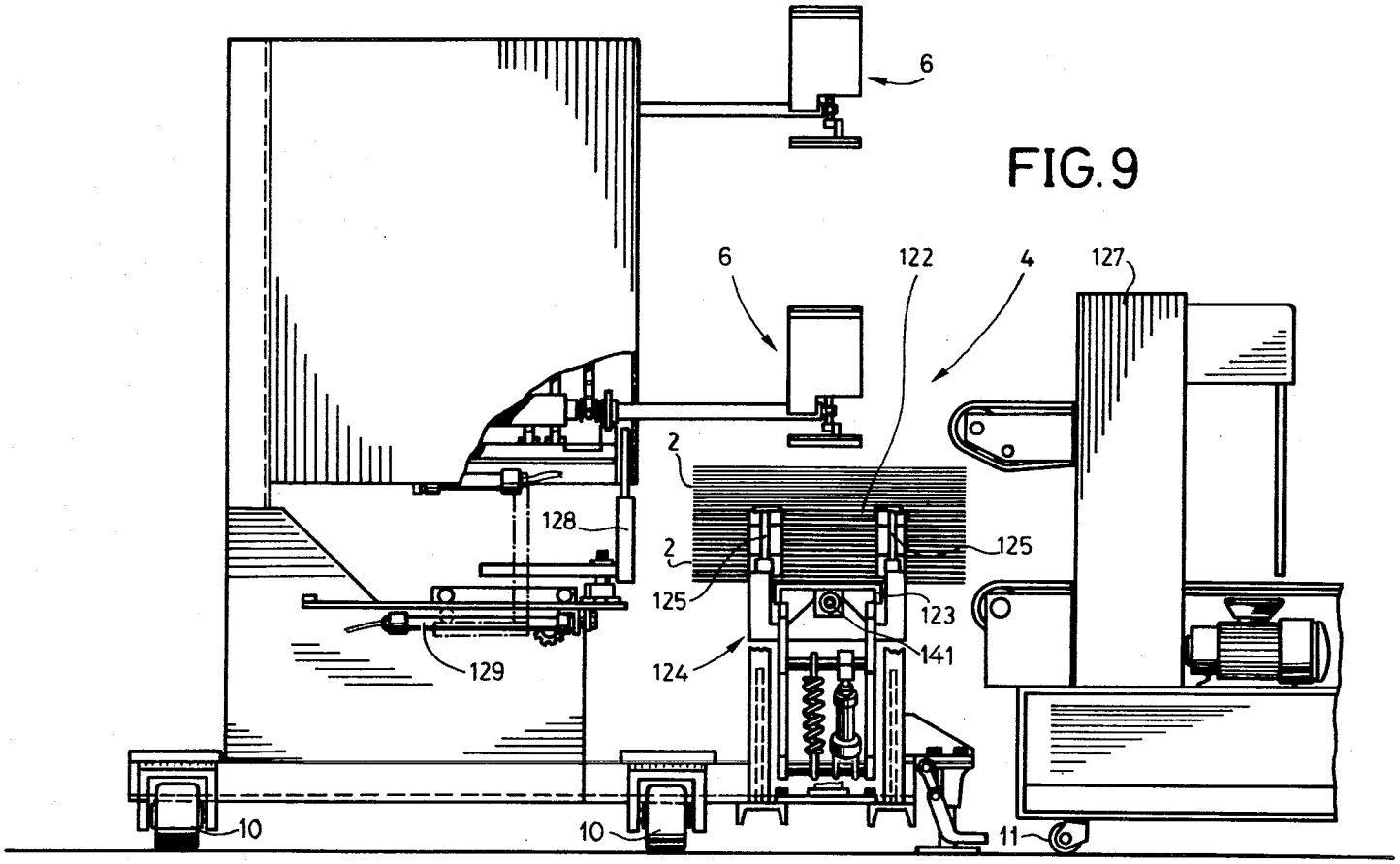
FIG. 9 is an end view with portions broken away for purposes of illustration of the device of FIG. 4.
Figure 10:
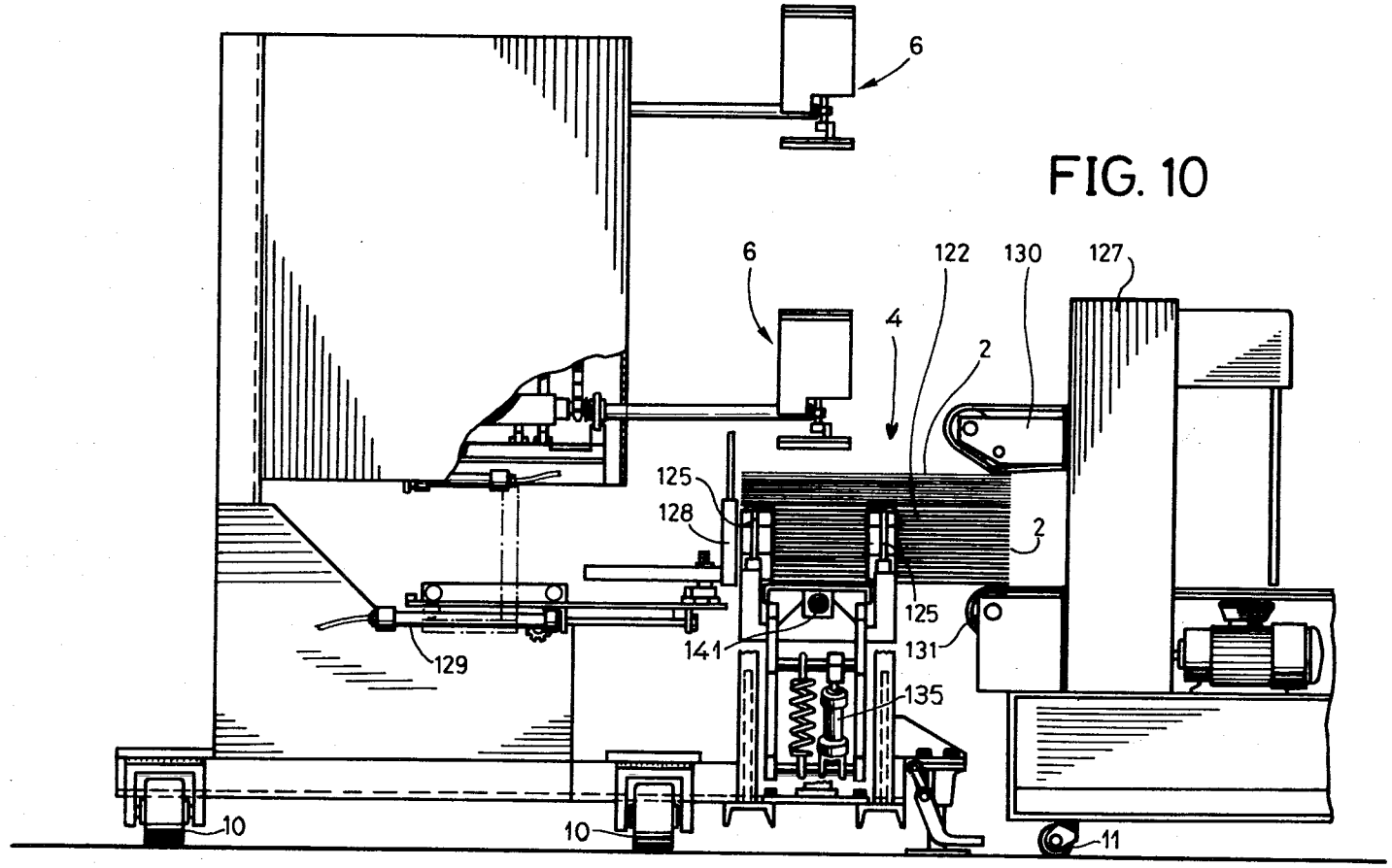
FIG. 10 is an end view similar to FIG. 9 showing the discharging of the packet.

A detailed view of the delivery station 4 is illustrated in FIGS. 9 and 10. In FIG. 9, the batches 2 of folded boxes or box blanks 13 are piled or superimposed head-to-tail to form a packet 122 which is lying on a plate 123 of a piling-up unit 124. The lower batch 2 is gripped by a first grasper means which is illustrated as two pinchers 125 that hold the batch on the upper surface of the movable table 123 (FIG. 14). The upper batch 2 is gripped by a second grasper means 126 which is illustrated in FIGS. 14 and 15. After each of the batches 2 are grasped by the first and second grasper means, the gripper means 6 are released to allow movement of the packet 122. After forming the packet 122, which formation will be discussed hereinafter, the packet is then introduced into an introduction or entry station of a tying or bundling machine 127 (FIGS. 9 and 10) by means of a pusher 128 which is advanced by a piston 129. The packet 122 as it enters the transport conveyors 130 and 131 of the next processing machine or bundling machine 127 in then released by the first grasping means 125 and second grasping means 126 to enable the packet to be delivered by the conveyors 130 and 131.

As best illustrated in FIGS. 14 and 15, the table 123 is pivotally mounted in a frame to move from a lower position 123′ to an upper position 123″. To cause this movement, as indicated by the arrow 134, a piston 135 is provided. The frame for the table 123 can be raised and lowered from the position 123″ to a position 123‴ best shown in FIG. 15 by a pneumatic piston 145. In addition, the table 122 is movable in the frame in the direction of an arrow 142 by a pneumatic piston 141.

Figure 12:
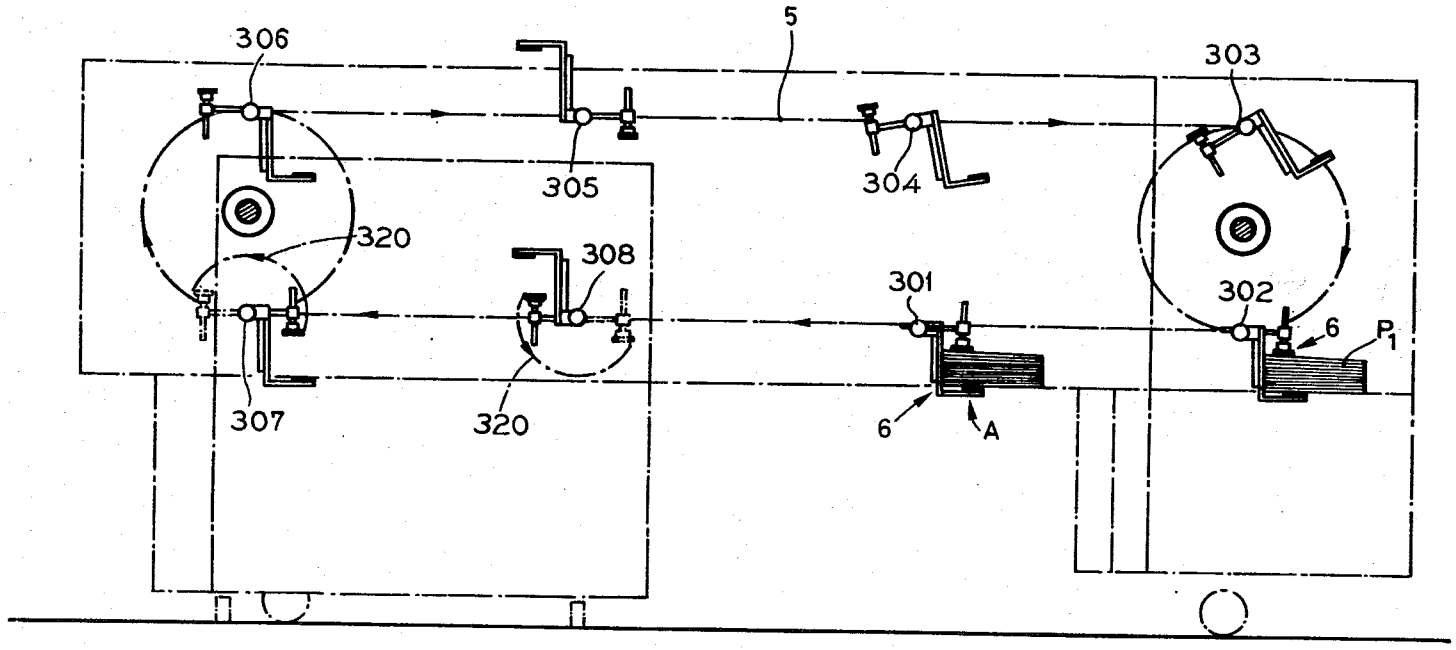
Figure 13:
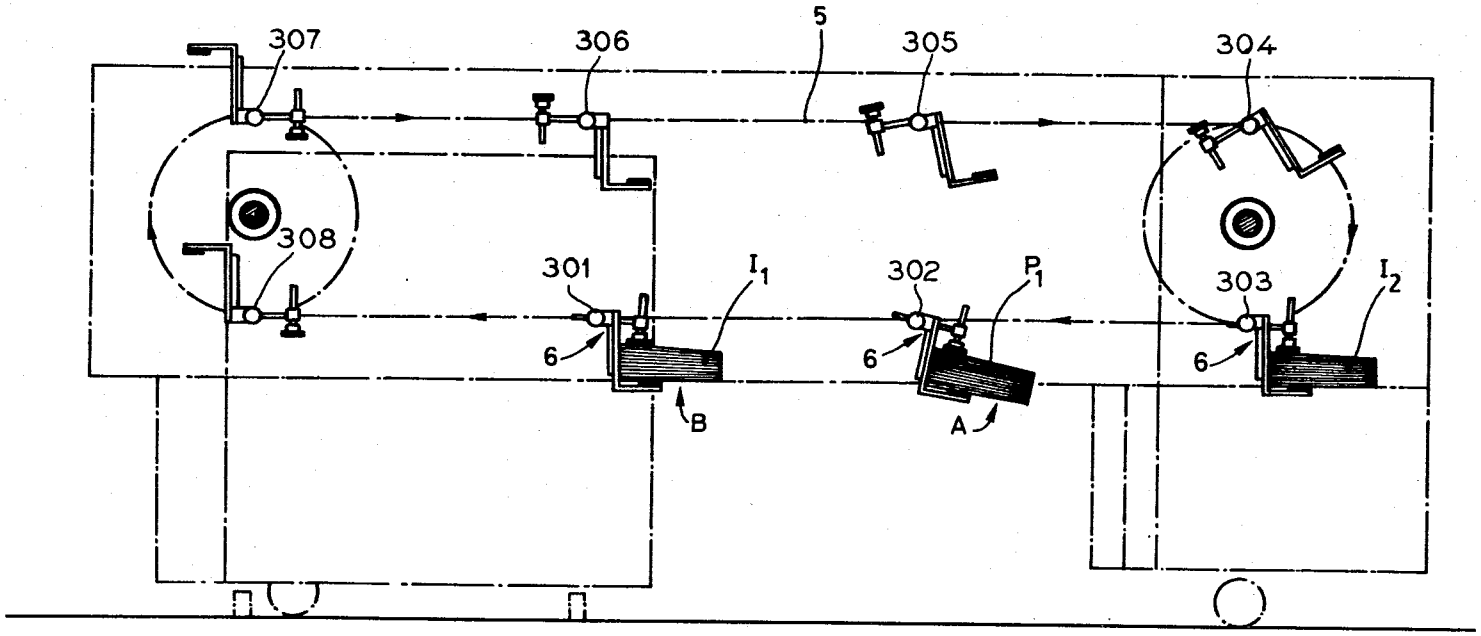

The operation of the device 200 is schematically illustrated in FIGS. 11–15. As illustrated in FIG. 11, a batch of the folded box blanks $I_1$ is formed on a lower jaw 7 of a gripper means 301. After the box blank has reached the desired height, the detector 14 of FIG. 2 actuates the interrupting means such as the fork unit 42 and also actuates the piston 82 to move the slide 81 with the roller 61 to cause the upper jaw 8 to move in the direction of arrow 321 to grip the batch $I_1$. After the gripping of the batch, the drive means at 132 is actuated to rotate the shaft 100 to advance the gripper means 301 to the position illustrated in FIG. 12 which is position A. As this occurs, the gripper means 302 is moved to the position which position 301 previously had and is in a retracted position such as 301*a* until the piston 80 is actuated to shift the slide 79 to the left to move the follower 53 from the track 71 to be in an alignment with the cam track 52. This shifting will cause the gripper means 302 to be pivoted from the retracted position as indicated by the arrows 310 to the ready position. With the gripper means 302 in the ready position, continual flow of the blanks will form a stack on the lower jaw 7. When the stack reaches the desired height, the detector 14 will initiate the cycle again. Thus, the upper jaw 8 will be moved to a gripping position on a batch $P_1$ as illustrated in FIG. 12. Again, the drive arrangement or means 132 is actuated to move the conveyor means 3 another given increment so that a new gripper 303 is positioned to receive a new stack $I_2$ while the stack $P_1$ in the gripper means 302 is moved to the position A previously held by the gripper means 301 which has now moved to a position B as illustrated in FIG. 13. After the batch $I_2$ has been grasped by the unit 303, the conveyor means is again stepped another increment so that the batch $I_1$ and the gripper means 301 is moved to a position C illustrated in FIG. 14. In addition, the batch $P_1$ while moving from position A in FIG. 13 to the position similar to B, is rotated on the axle 12 by 180° to assume a position D with the leading edges become the trailing edge as illustrated in FIG. 14. This rotation is due to the follower 53 traveling in the portion 52*a* of the cam track 52 to shift the yoke 54 which as mentioned hereinabove causes a complete rotation of both the upper and lower jaws.

During the first part of the operation while the batches $I_1$ and $P_1$ are in the positions C and D, respectively, of FIG. 14, the table 123 is pivoted from the position 123′ to the position 123″ and the first grasping means 125 are shifted to grip the leading edge of the batch $I_1$. This movement can be instituted by means of a linear cam or a pneumatic piston which are not illustrated. At the same time, the second grasper means 126 is actuated so that its lower jaw 136 and its upper jaw 137 will grasp what is now the trailing end of batch $P_1$. Actuation of the jaw 137 is by a pneumatic piston 140.

As illustrated in FIG. 15, the upper jaw 8 of the gripper means 301 is moved in the direction of arrow 143 to release the bundle $I_1$. This movement is caused by the follower 62′ (FIG. 4) from being shifted by the slide 74 from the track portion 62′ to the track 78. At the same time, the slider 75 shifts the roller 62 of the unit 302 between the tracks 62 and 78 to cause the upper jaw 8 of the unit 302 to move in the direction 144 to disengage the batch $P_1$. After the batch $I_1$ is released by the gripper means 6 the table 123 with the batch $I_1$ clamped by the first grasper means 125 is moved by the two pistons 141 and 145 in a path 142 which shifts the batch $I_1$ to a position C′. As illustrated, the movement shifts the table 123 downward from the position 123″ to the position 123‴ due to the action of the pneumatic piston 145 and shifts the bundle $I_1$ in a direction opposite to the direction 138 to the position C′ which is directly beneath the position D of the batch $P_1$. The batch $P_1$ is now shifted from position D to position D′ by a piston 139 shifting the grasper means 126 vertically downward so that the two batches are superimposed together with the trailing edge of the batch $P_1$ as formed at the receiving end lying on the leading edge or end of the batch $I_1$ to form a head-to-tail arrangement. The packet 122, which is made up of the two batches $I_1$ and $P_1$, is then pushed into the tying or bundling machine 127 as illustrated in FIGS. 9 and 10. The following batches $I_n$ and $P_n$ which are not illustrated are formed in the following manner in the continuous mode of operation of the device.

Each of the pistons mentioned in the operation and structure of the device 200 are preferably pneumatic pistons. Thus, the device 200 can operate all these pistons from a single pneumatic source such as a compressed air system which is commonly used in any board processing plant. Therefore, the device does not require any elements, that need an electrical source for their operation and the maintenance and operation, of the device can be done by operators who only have a knowledge of pneumatic and mechanical services and do not require any electrical control systems. Another advantage of the machine or device 200 is that it enables a continued processing of large folded box blanks which can be piled head-to-tail and face-to-face by an automatic rotation while still keeping the box blanks arranged with their closing flaps and glue points facing each other.

Although various minor modifications may be suggested by those versed in the art, it should be understood that I wish to embody within the scope of the patent granted hereon, all such modifications as reasonably and properly come within the scope of my contribution to the art.

I claim:

1. A device for continuously receiving a flow of box blanks from a delivery end of a box blank processing apparatus and discharging a packet of two batches of box blanks in a head-to-tail arrangement to another processing apparatus, said device comprising receiving means for creating batches of box blanks from a flow of blanks; delivery means for assembling the two batches into a packet with a head-to-tail arrangement and discharging the packet to the next processing apparatus; and conveyor means for transporting the batches between the receiving means and the delivery means, said conveyor means including a chain means forming a continuous endless path between the receiving means and delivery means, a plurality of gripper means for grasping a batch of blanks being supported on the chain means with a given spacing, drive means for moving the chain means along the path, means for selectively actuating and deactuating the gripper means and means for rotating selected gripper means through 180° during movement along a portion of the path to form a turned batch, said receiving means including means for piling blanks in a stack, means for controlling the flow of blanks to the means for piling and interrupting the flow while transporting a batch from the means for piling, and said delivery means including a first grasper means for gripping a batch in a gripper means of the conveyor means, second grasper means for gripping a following turned batch, said first and second grasper means being movable relative to each other to superimpose the two batches into a packet of two batches, and pusher means for moving the packet to a position for transfer to the next processing apparatus.

2. A device according to claim 1, wherein said means for controlling and interrupting include detector means for sensing the thickness of the pile of blanks and auxiliary transporting means for moving the flow of blank to the piling means including an upper conveyor and a lower conveyor.

3. A device according to claim 1, wherein each of the gripper means includes a lower jaw and an upper jaw.

4. A device according to claim 3, wherein said drive means intermittently moves the chain means with each gripper means being positioned in succession at the means for piling during the dwells in the movement, and said means for piling guiding the flow of blanks to form a pile on the lower jaw of the gripper means positioned thereat.

5. A device according to claim 1, wherein said means for controlling and interrupting include a fork unit movable between a first position guiding the flow of blanks into said means for piling and a second position stopping flow at a point upstream of the flow, said fork unit including a first and second finger, said first finger having a hook-shaped end which is withdrawn from the flow of blanks while the fork unit is in the first position and engages the blanks of the flow when the unit is in the second position, said second finger being a blank guidance finger which guides blanks from the hook of the first finger when the fork unit is in the first position and is withdrawn to expose the hook to the blanks when the unit is in the second position.

6. A device according to claim 1, wherein said drive means intermittently moves the chain means with a dwell between movement, said drive means including at least one drive unit comprising a pinion connected to a drive shaft by a one-way clutch, a rack gear connected to a piston engaging the pinion so that as the piston is moved back and forth, the shaft is rotated during only one direction of movement.

7. A device according to claim 6, which includes two drive units.

8. A device according to claim 1, wherein said gripper means being subdivided into first and second groups with the gripper means of the first group being mounted on the chain means alternately with the gripper means of the second group, said means for rotating selected gripper means acting on the first group and comprising each of the gripper means of the first group having a yoke with a follower slidably received on a shaft of the chain means extending transverse to the direction of movement of the chain means, and a first cam track receiving the follower of the yoke so that as the follower moves along the cam track, the gripper means is rotated on said shaft.

9. A device according to claim 8, wherein each of the gripper means of the second group have a yoke with a follower slidably received on the shaft extending parallel to the first-mentioned shafts, a second cam track receiving the follower of the second group, said second cam track being different than the first track so that the gripper means of each group are rotated on the shaft at different positions on the path.

10. A device according to claim 9, which includes means for selectively rotating the second group of gripper means by 60° comprising a portion of the second cam track being selectively displaceable from the other portions of the second cam track as a follower moves therealong.

11. A device according to claim 9, wherein each of said gripper means includes a lower jaw and an upper jaw pivotable from an engaging position to a disengaging position, means for moving said upper jaw between said positions comprising a sleeve slidable on the shaft, said sleeve having a helical groove receiving a roller secured to said shaft so that movement of the sleeve along the shaft causes rotation thereof and means for sliding the sleeve along said shaft between two positions.

12. A device according to claim 11, wherein said means for sliding comprises a roller attached to each sleeve, a track receiving said roller, said track having laterally displaced portions corresponding to the first and second positions of the sleeve, and a transfer device for moving the roller between the two displaced positions.

13. A device according to claim 9, wherein said first and second cam tracks extend along the entire continuous paths of chain belts with a lateral gap at one point, and transfer means for moving each follower laterally across the lateral gap.

14. A device according to claim 1, wherein the delivery means includes a table associated with the first grasper means, said table being movable along the direction of movement of the chain means and vertical thereto to enable positioning the table and batch held by the first grasper means beneath the turned batch held by the second grasper means to form the packet.

15. A device according to claim 14, wherein the second grasper means has a pair of jaws and means for moving the jaws in a vertical direction.

16. A device according to claim 15, wherein said pusher means move the packet laterally relative to said path.

17. A device according to claim 1, wherein said pusher means move the packet laterally to the path into the receiving end of the next processing apparatus.

18. A method for continuously receiving a flow of box blanks from a delivery end of a first box blank processing apparatus and assembling a packet of two batches in a head-to-tail arrangement to be provided to a second processing apparatus, said method comprising the steps of forming a plurality of batches of the box blanks by receiving a flow of box blanks from said first processing apparatus, piling the blanks of the flow into a stack, intermittently interrupting the flow to enable a gripping of the stack of blanks and removing the stack as a batch from the area where the stack is formed and then resuming the step of piling to form a subsequent stack which when reaching the desired height is gripped and removed as a second batch; transporting the batches along a path, rotating every second batch by 180° around an axis extending transverse to the direction of movement in the path to create a turned batch; forming a packet by grasping the first batch at a delivery station, grasping the turned second batch at the delivery station, moving the first and second batches relative to each other to superimpose the batches together to form the packet of two batches with the batches in a head-to-tail arrangement; moving the packet of grasped batches with a pusher to a position for being received at a receiving end of the second apparatus and subsequently releasing the packet to enable discharge into the second apparatus.

19. A method according to claim 18 which includes rotating each of the first batch by 60° around an axis extending transverse to the direction of movement simultaneously with the step of rotation of the second batch.

20. A method according to claim 18, wherein the step of transporting a batch along said path includes substantially maintaining each first batch without any rotating as the second batch is rotated.

* * * * *